US008210265B2

(12) United States Patent
Alikin et al.

(10) Patent No.: US 8,210,265 B2
(45) Date of Patent: Jul. 3, 2012

(54) ALUMINUM RISER ASSEMBLY

(75) Inventors: Rudolf S. Alikin, Moscow (RU); Boris S. Vygodskiy, Moscow (RU); David J. Indrupskiy, Moscow (RU); Alexander M. Podrazhanskiy, Moscow (RU); Mikhail A. Gelfgat, Moscow (RU)

(73) Assignee: Aquatic Company, Moscow (RU)

( * ) Notice: Subject to any disclaimer, the term of this patent is extended or adjusted under 35 U.S.C. 154(b) by 353 days.

(21) Appl. No.: 12/435,034

(22) Filed: May 4, 2009

(65) Prior Publication Data

US 2009/0272537 A1 Nov. 5, 2009

Related U.S. Application Data

(60) Provisional application No. 61/050,242, filed on May 4, 2008.

(51) Int. Cl.
*E21B 17/01* (2006.01)

(52) U.S. Cl. ..... 166/367; 166/345

(58) Field of Classification Search ..... 166/367, 166/351, 359, 345, 350, 344, 339, 348; 414/22.51
See application file for complete search history.

(56) References Cited

U.S. PATENT DOCUMENTS

| | | | | |
|---|---|---|---|---|
| 4,043,575 | A | 8/1977 | Roth | |
| 4,093,030 | A * | 6/1978 | Bonds | 166/382 |
| 4,097,069 | A * | 6/1978 | Morrill | 285/84 |
| 4,402,533 | A * | 9/1983 | Ortloff | 285/18 |
| 4,487,434 | A * | 12/1984 | Roche | 285/93 |
| 6,401,825 | B1 | 6/2002 | Woodrow | |
| 6,415,867 | B1 | 7/2002 | Deul et al. | |
| 6,450,395 | B1 | 7/2002 | Deul et al. | |
| 6,615,922 | B2 | 9/2003 | Deul et al. | |
| 6,902,699 | B2 | 6/2005 | Fritzemeier et al. | |
| 7,077,436 | B1 | 7/2006 | Krywitsky | |
| 2002/0096335 | A1 | 7/2002 | Deul et al. | |
| 2006/0088725 | A1 | 4/2006 | Ruggiero et al. | |
| 2007/0044973 | A1 | 3/2007 | Fraser | |
| 2007/0152441 | A1 | 7/2007 | Jennings et al. | |

(Continued)

FOREIGN PATENT DOCUMENTS

JP 2004/337966 A 12/2004

(Continued)

OTHER PUBLICATIONS

Deul, Hans; T. Prosser; B. Rhone, "Aluminum-alloy riser extends driller's reach into deeper water," Oil & Gas Journal, Jul. 7, 2003, pp. 53-56.

(Continued)

*Primary Examiner* — Thomas Beach
*Assistant Examiner* — Aaron Lembo
(74) *Attorney, Agent, or Firm* — Wong, Cabello, Lutsch, Rutherford & Bruculerri, LLP

(57) ABSTRACT

An aluminum riser assembly has a plurality of riser joints connectable together to form a riser string. When upper and lower joints are assembled, clamps support auxiliary pipes for carrying hydraulic lines. A drive rotates a sleeve rotatably supported on the upper joint, and the sleeve rotates a union nut rotatably disposed on the upper joint. As the union nut rotates, it moves axially along the riser joint and threads onto the lower joint. The union nut is tightened until it engages an external collar to complete the coupling between the upper and lower riser joints. The entire process can then be repeated for additional upper riser joints to make up a riser string.

37 Claims, 8 Drawing Sheets

U.S. PATENT DOCUMENTS

2007/0261226 A1 11/2007 Deul et al.

FOREIGN PATENT DOCUMENTS

WO 01/63161 A1 8/2001
WO 2007/133928 A2 11/2007

OTHER PUBLICATIONS

Cottrill, Adrian, "Noble puts its hope for future into aluminium," UPSTREAM, vol. 8 week 25, Jun. 20 2003, Technology Focus p. 6.
Afanasiev, Vladimir, "Military route for Russian suppliers," UPSTREAM, vol. 8 week 25, Jun. 20 2003, Technology Focus p. 6.
Greenburg, Jerry, "Different riser material compete for acceptance," Drilling Contractor, May/Jun. 2003, pp. 30-31.
"Noble puts aluminum to the test," UPSTREAM, vol. 7, week 41, Oct. 2002, p. 23.
Fine et al., "Aluminium alloys for offshore drilling systems," 14th ASME et al Offshore Mech. & Arctic Eng. Int. Conf., Jun. 18-22, 1995, pp. 299-306, XP001027935, Copenhagen, Denmark.
Gelfat, M. et al., "High-Strength Aluminum Alloys for Deepwater Riser Applications," Offshore Technology Conference, OTC 16185, copyright 2004.
Aquatic Company, "Aluminum Drilling Riser Literature," obtained from http://www.aqua-co.com, generated Apr. 18, 2008.
Alikin, Rudolf et al., "Russian Aluminum Alloys for Ultra Deep Water Production Risers," Int'l. Conf. on Subsea Tech., SubSea Tech '2007, Jun. 2007.
Deul, Hans et al., "Aluminum Alloy Riser Allows for Deeper Drilling on Existing Rigs," SPE/IADC Drilling Conference, SPE/IADC 92559, copyright 2005.
Abstract of Tikhonov et al.; "Selection of parameters and bending vibrations for deepwater drilling aluminum riser in random waves," 17th Int. Conf. on Offshore Mechanics and Arctic Engineering, Jul. 5-9, 1998, XP001027925, Lisbon, Portugal.
Search Report & Written Opinion from counterpart PCT application No. PCT/US2009/042696, dated Sep. 23, 2009.
First Examination Report for Australian counterpart Appl. No. 2009245441, dated Jul. 20, 2011.
First Examination Report for Russian counterpart Appl. No. 2010149613, dated Nov. 9, 2011 along with summary from Foreign Associate.

* cited by examiner

ALUMINUM RISER ASSEMBLY

CROSS-REFERENCE TO RELATED APPLICATIONS

This is a non-provisional of U.S. Provisional Appl. Ser. No. 61/050,242, filed May 4, 2008, to which priority is claimed and which is incorporated herein by reference in its entirety.

BACKGROUND

Offshore drilling rigs, such as fixed platforms, jack-up or semi-submersible platforms, and drill ships, used in hydrocarbon production, normally use a riser to connect the rig with a wellhead at the seabed. In use, the riser keeps water from the drilling string and conveys circulated drilling mud. Typically, the riser has sections of metal pipe that are positioned vertically between the rig and wellhead. These pipe sections include peripheral auxiliary lines and pipes for communicating hydraulic lines between the rig and a blowout preventer at the wellhead.

The significant weight of steel risers is one drawback that limits their use in deep-sea operation. As is know, each of the steel pipe sections of the riser must have an adequate wall thickness to handle working pressures and to withstand the tensile load of other sections. These requirements add weight to the riser string. In turn, the weight of the riser string can be substantially limited to payload capacity of the floating rig that can only carry a limited number of sections without exceeding its maximum load limit.

As an alternative to the use of steel, an aluminum riser known in the prior art uses sections of aluminum pipe serially coupled together by flange connectors at the ends of the pipe. An example of such an aluminum riser is disclosed in U.S. Pat. Nos. 6,415,867 and 6,615,922. These flange connectors have openings for bolts and threaded inserts to connect the flange connectors together and have openings for carrying auxiliary pipes longitudinally along the pipe's periphery. To make a reliable connection, operators must tighten each bolt with a specified torque. Some riser designs may have anywhere from 6 to up to 18 bolts per connection. Consequently, assembling the sections of pipe can takes significantly operators considerable time to complete and verify.

In yet another drawback, the prior art riser assembly is made from the aluminum alloy 1980 T1 OCT 192048-90 (i.e., an aluminum alloy known as Russian Designation AL 1980 T1). (The "T1" designation is an equivalent to "WP" as described in R 0067—Alloy Temper Designation System for Aluminum (ANSI H35.1—2000). The letter "W" signifies "Solution Heat Treated"). For such thermo-strengthened alloys, the weld must be heat treated after welding. This makes it more difficult to fabricate the joints because the heat treatment procedure demands additional production time, personnel and equipment.

SUMMARY

An aluminum riser assembly has a plurality of riser sections connectable together to form a riser string. Each of the riser sections has a pipe with upper (box) and lower (pin) connectors welded thereon. The upper connector has an internal tapered surface forming a box end and has an external tapered surface with an external thread. The lower connector has an external tapered surface. The internal and external tapered surfaces align and seal with one another and facilitate making up of the riser string. Preferably, components of the riser section are composed of an aluminum alloy that has a higher "strength-to-density" ratio compared with steel and, more particularly, are composed of a non-heat-strengthened aluminum alloy 1575 as per TU1-809-420-84 specification or composed of another aluminum alloy of the Al—Mg system that does not require heat treatment of welds after welding.

When upper and lower riser sections are assembled, the pin of the upper riser joint fits partially into the box of the lower riser joint so that the aligned and sealed tapered surfaces engage one another. Operators orient and align service lines to make up the two riser joints. Operators then use a hydraulic or pneumatic driver or actuator to rotate a beveled gear on a drive shaft supported on one of the supports. This beveled gear is mated with the beveled teeth formed around the edge of a sleeve that is rotatably supported on the pin's end of the upper riser section. Rather than using a beveled gear arrangement, the outside circumference of the sleeve can have a first sprocket or pin gear, and the drive can have a second sprocket or trundle mateable with the pin gear.

As the sleeve is rotated by the driver, a plurality of downward extending fingers on the sleeve rotates a union nut. Alternatively, dowel pins or bearings disposed in pockets of the union nut, and longitudinal slots in the sleeve cause the union nut to rotate. The union nut is also rotatably disposed on the pin's end of the riser joint and can also move axially along the riser joint during rotation against the bias of a spring. As the sleeve is rotated, thread on its internal tapered surface threads with the external thread on the lower section's upper end. The union nut is tightened until internal tapered surface of the box and external tapered surface of the pin will join. The entire process can then be repeated for additional riser joints to make up a riser string.

DETAILED DESCRIPTION

Figure 1:
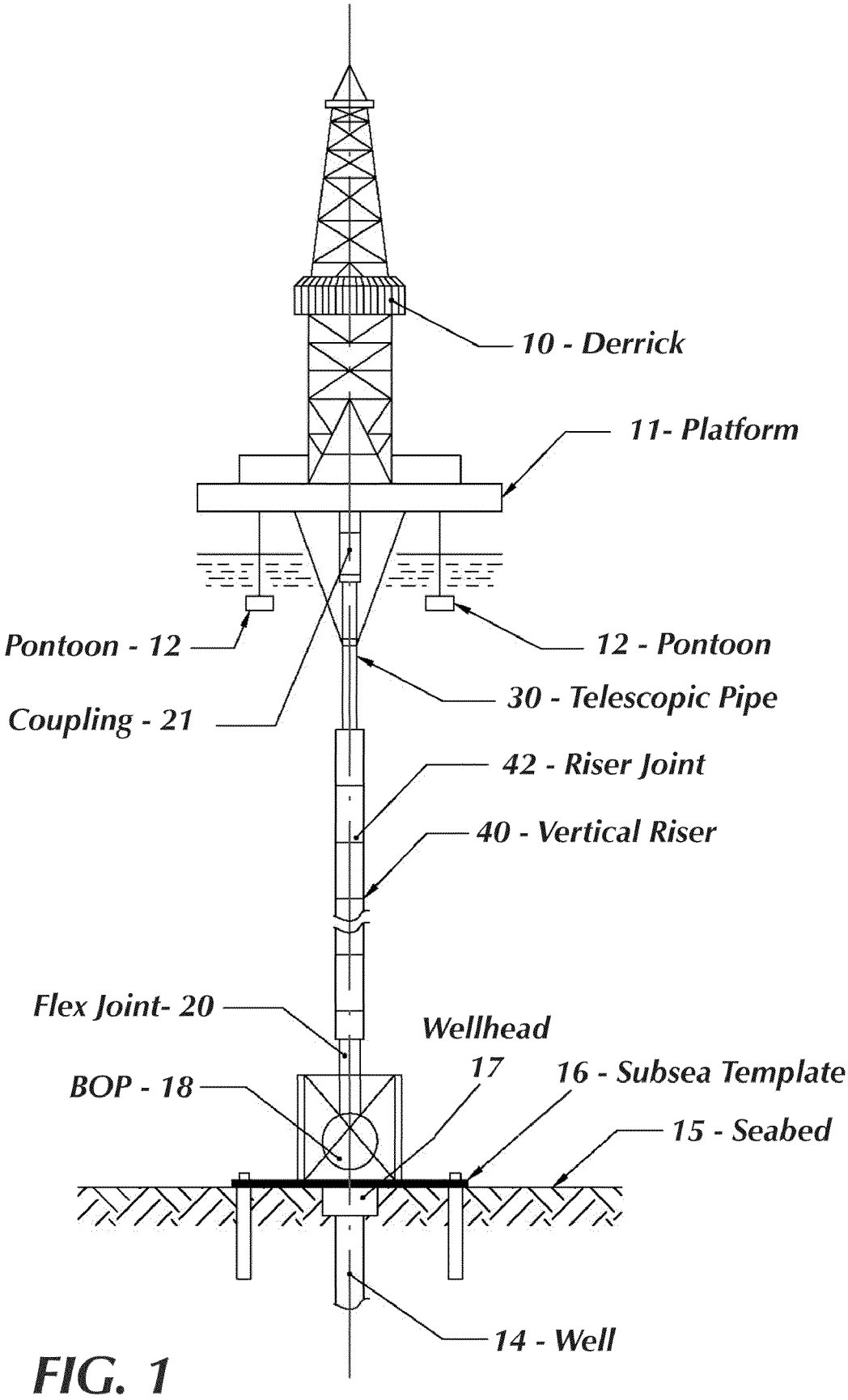
FIG. 1 schematically illustrates an offshore drilling rig with underwater drilling equipment.

FIG. 1 shows an offshore drilling rig (i.e., semi-submersible platform) having a derrick 10, a platform 11 with drilling equipment on it, and pontoons 12. The offshore drilling rig can also be a fixed platform, jack-up platform, drill ship, etc. A wellbore 14 and subsea template 16 are located at the seabed 15, and a vertical riser 40 is positioned between the wellbore 14 and the rig's platform 11. The subsea equipment includes a wellhead 17 and a blowout preventer 18.

A riser string 40 connects the platform 11 with the blowout preventer 18 and uses a coupling 21, a flex joint 20, and a telescopic joint 30 to compensate for movement of the platform 11 relative to the wellbore 14. The riser string 40 has a plurality of riser joints 42 connected end-to-end to make up the riser string. The main function of the riser 40 is to guide drill pipes and tools to the wellbore 14 and to provide a return pathway for circulated drilling mud.

As is known, each riser joint 42 must be able to withstand a number of forces and loads, such as internal and external pressures, tensile loads caused by lower riser joints 42, and bending loads. In addition, each riser joint 42 is also preferably able to withstand high temperatures and the corrosive effects of both drilling mud and salt water. Accordingly, each riser joint 42 is constructed of a suitable metal material. In a preferred embodiment detailed below, components of the riser joints 42 are composed of an aluminum alloy that has a higher "strength-to-density" ratio compared with steel. This property of the riser joints 42 advantageously increases the number of sections 42 that can be used for a given load capacity of the drilling rig.

Figure 2:
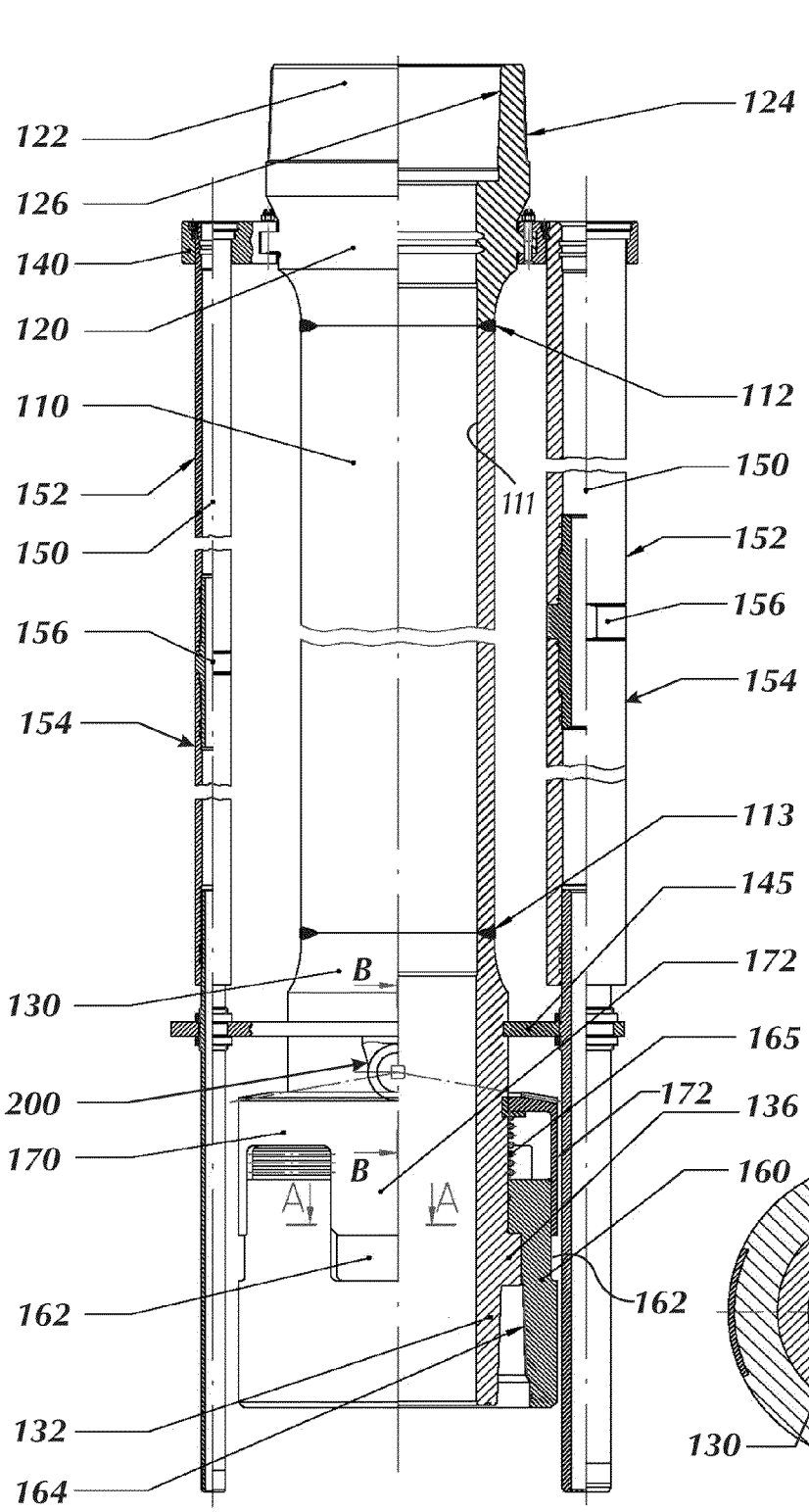
FIG. 2 is a partial cross-sectional view of a riser section according to certain teachings of the present disclosure.

In FIG. 2, a riser section 100 according to certain teachings of the present disclosure is illustrated in partial cross-section. The riser section 100 includes a main pipe 110, upper and lower connectors 120/130, supports or clamps 140/145, quantity number of intermediate clamps (not shown), auxiliary pipes 150, a rotatable union nut 160, a rotatable sleeve 170, and a driver 200 for turning the sleeve 170 and union nut 160. The riser section 100 can also have a buoyancy module (not shown), which can include two half moon pieces of foam containing hollow glass balls, bolted to each other and clamped around the pipe 110.

The main pipe 110 has a bore 111 therethrough. The connectors 120/130 are welded to ends of the pipe 110 by welds 112/113, which preferably do not require thermal treatment. These connectors 120/130 are different from one another. In particular, the upper connector 120 has a box 122 with external tapered thread 124 and has an internal tapered surface 126. Likewise, the lower connector 130 has an external tapered surface 132 and a collar 136.

The main pipe 110 is preferably composed of an aluminum alloy, as are the connectors 120/130. More particularly, the pipe 110 and connectors 120/130 are preferably composed of a non-heat-strengthened aluminum alloy 1575 as per TU1-809-420-84 specification that requires no weld annealing after welding. This simplifies the manufacture and assembly of the riser joint 100 when the connectors 120/130 are welded to the pipe 110 at welds 112/113 and also reduces the production costs and time of the riser section 100. Although the connectors 120/130 are also preferably made of the same aluminum alloy as the main pipe 110, in other embodiment of the disclosed riser section 100, the main pipe 110 and the connectors 120/130 may each be made of different aluminum alloys, and each may be made of an aluminum alloy different from the non-heat-strengthened aluminum alloy 1575 as per TU1-809-420-84 specification. Some examples of aluminum alloys include the aluminum alloys known as Russian Designation AL 1980 and Russian Designation AL 1953 and include any other aluminum alloy having a high strength-to-density ratio greater than that of steel.

The auxiliary pipes 150 are mounted on the clamps 140/145 positioned on the pipe's connectors 120/130 and on the intermediate clamps (not shown) located at various intervals along the main pipe 110. The auxiliary lines carried by these pipes 150 can include choke and kill lines, hydraulic lines, booster lines, etc. As shown, each auxiliary pipe 150 has upper and lower segments 152/154 connected together by a threaded coupling 156.

Figure 3:
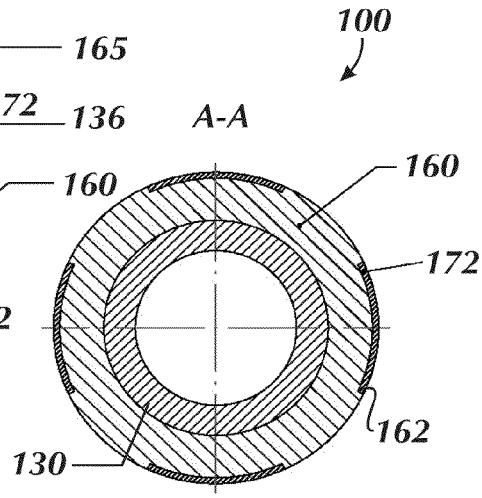
FIG. 3 is end-sectional view of the riser section in FIG. 2 along lines A-A.

The union nut 160, the sleeve 170, and the driver 200 position at the lower (pin) connector 130 of the pipe 110 and are used to mate the riser joint 100 to another such riser joint. As shown, the union nut 160 positions on the pipe's lower connector 130 and can abut against the upper face of the collar 136. This union nut 160 has an interior tapered thread 164 for making up riser joints as discussed below. The union nut 160 also has outer longitudinal slots 162 formed along its top for engaging the sleeve 170. The sleeve 170 mounts above the union nut 160 and has fingers 172 positioned in the outer slots 162 of the union nut 160, as best shown in the cross-section of FIG. 3. A spring 165 is mounted about the lower connector 130 and biases the union nut 160 away from the sleeve 170 towards the collar 136.

With the rotation of the sleeve 170 by the driver 200 as detailed below, the union nut 160 also rotates and can move axially along the lower connector 130 against the bias of the spring 165 to couple the riser joint 100 with another joint. The connection provided with the union nut 160, sleeve 170, and driver 200 advantageously allows operators to assemble the riser sections 100 efficiently while aligning the auxiliary pipes and without requiring the installed pipes to be rotated for assembly.

Figure 4:
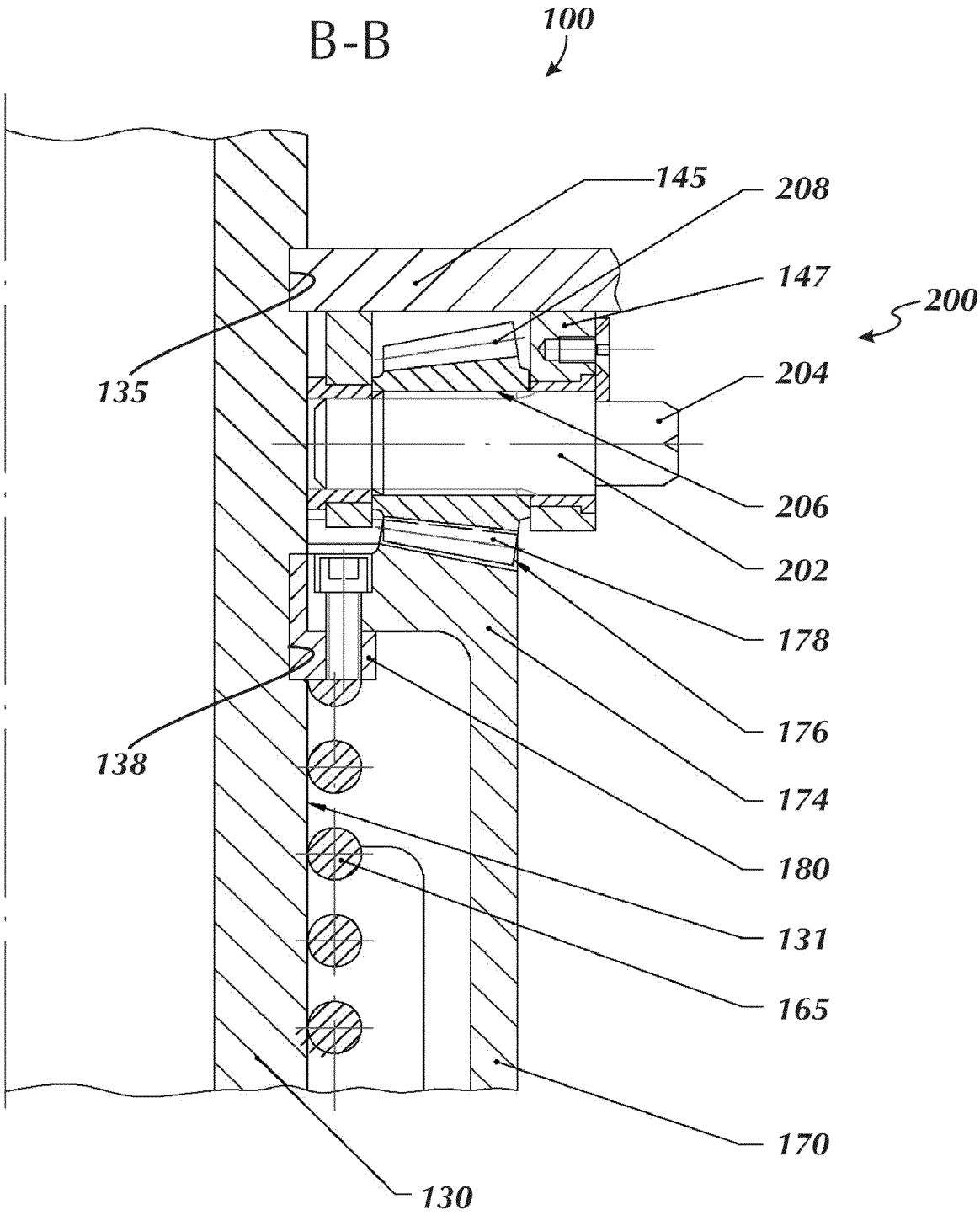
FIG. 4 is a detailed cross-sectional view of the riser joint in FIG. 2 along lines B-B showing the sleeve with beveled teeth and pinion gear driver for assembling riser joints together.

Further details of the sleeve 170 and driver 200 are provided in FIG. 4. As shown, the clamp 145 fits into an outer groove 135 around the lower connector 130, and a split bushing 180 fits into another outer groove 138 and supports the rotatable sleeve 170 thereon. The upper end of the spring 165 positions against this bushing 180 and fits around the outside 131 of the lower connector 130.

Bracket 147 supports the driver 200 on the lower face of the clamp 145 between the clamp 145 and the upper edge 174 of the sleeve 170. The driver 200 includes a drive shaft 202 having a square head 204 on its outer end and having a pinion gear 206 with beveled teeth 208 on the other. The sleeve's upper edge 174 has a beveled rim 176 with teeth 178 formed thereon that mate with the pinion gear's teeth 208. As discussed below, a hydraulic or pneumatic tool can couple to the square head 204 to rotate the shaft 202 and pinion gear 206. In turn, the pinion gear 206 mated with beveled rim 176 rotates the sleeve 170 around the pipe's lower connector 130, which in turn rotates the union nut 160 (FIG. 2) around the pipe's lower connector 130.

Figure 5:
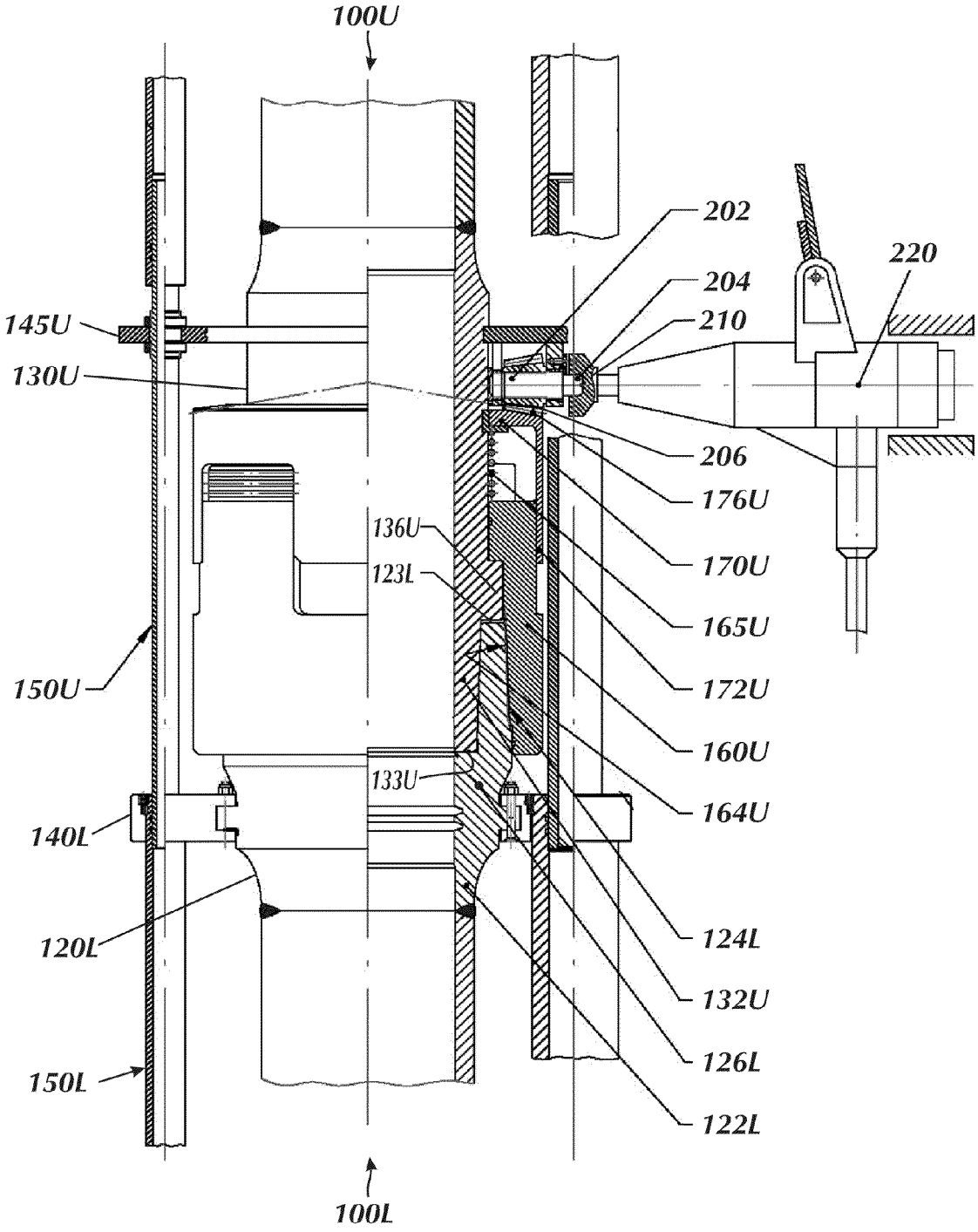
FIG. 5 is a partial cross-sectional view of two riser sections assembled together.

With an understanding of the various components of the riser section 100, discussion now turns to the process of coupling riser joints together to make up a riser string for running to the seabed. As shown in FIG. 5, a lower riser joint 100L that has been previously made up on the riser string is shown in a lower position, and an upper (following) riser joint 100U is shown above ready to be made up with the lower joint 100L. The lower riser joint 100L is supported by its upper (box) connector 120L with a spider-elevator (not shown) on the derrick deck of the drilling platform. To make up the joints 100U-L, the upper riser joint 100U also suspended on a spider-elevator is lowered onto the lower riser joint 100L. Then, operators fit the upper section's connector 130U into the lower section's connector 120L by disposing the tapered pin 132U into the lower's box 126L.

In seating the connectors 120L/130U, operators align the ends of the auxiliary pipes 150U/150L held by auxiliary clamps 140L/145U aligned. Advantageously, fitting of the upper's pin 132U in the lower's box 126L facilitates installation of the riser sections 100L/100U so that operators do not have to pre-align the riser joints, reducing assembly time.

When the connectors 120L/130U have been fully seated and the auxiliary pipes 150U/150L have been coupled, the two riser sections 100L/100U will be aligned and require no additional intervention. This arrangement prevents the two sections 100L/100U from moving in a horizontal plane by external actions and offers integrity to the auxiliary lines in the junction area. With the connectors 120L/130U seated, the upper's external tapered pin 132U engages the lower's internal tapered box 126L for sealing. In addition, the upper's end 133U fits against an internal shoulder of the lower's box 126L. Likewise, the lower's distal end 123L fits adjacent the upper's collar 136U. Furthermore, the union nut 160U engages the lower's connector 120L so that the union nut 160U moves up in the space below sleeve 170U against the bias of the spring 165U. However, the union nut's internal thread 164U does not yet thread with the outer tapered thread 124L of the lower connector 120L until actuated by the driver 200 (FIG. 2) as described below.

To operate the driver 200 and complete the coupling, operators then fit a socket 210 on to the square head 204 of the drive shaft 202 and operate a pneumatic or hydraulic tool 220. As the shaft 202 rotates, the pinion gear 206 mated with the geared rim 176U turns the sleeve 170U, thereby rotating the union nut 160U and mating its thread 164U onto the lower section's outer thread 124L. Because the sleeve 170U connects with the union nut 160U by the fingers 172U, the union nut 160U can move axially in the space below the sleeve 170U against the bias of the spring 165U as the tapered threads 124L/164U are mated together. The amount of required torque to make up the connection can be controlled using appropriate pressure on the driver 220's pressure gauge.

As it is rotated, the union nut 160U may be tightened until it engages the collar 136U. Tightening the union nut 160U produces a sealed condition via the metal-to-metal sealing between the contacting surfaces of the box 126L and pin 132U. This eliminates the need for substantial elastomeric sealants or other seals that can be subject to crushing during assembly. To further enhance sealing, the upper section's end 133U may define a groove for an O-ring seal (not shown) for sealing against the internal face of the lower box 126L.

Once the threading has been completed, operators release the socket 210 from the driver 200, lift the made-up joints 100L/100U, after releasing the lower section 100L from the spider-elevator. To begin coupling a new riser joint, operators then lower these two assembled joints 100L/100U through the platform and seat the upper joint's connector (not shown) on the spider-elevator. After hook bails of a crown block system are released, operators grab another upper riser section (not shown) with the spider-elevator and places it above the riser section 100U to repeat the entire assembly process for this new riser joint.

As evidenced above, the assembly process can significantly reduce the time required to assemble/disassemble the riser joint 100. Likewise, by using the aluminum weldable structural alloy for the riser joint that requires no heat treatment of a semi-finished pipe and its welds to the connectors can likewise reduce the time and costs associated with producing the riser joints.

Figure 6B:
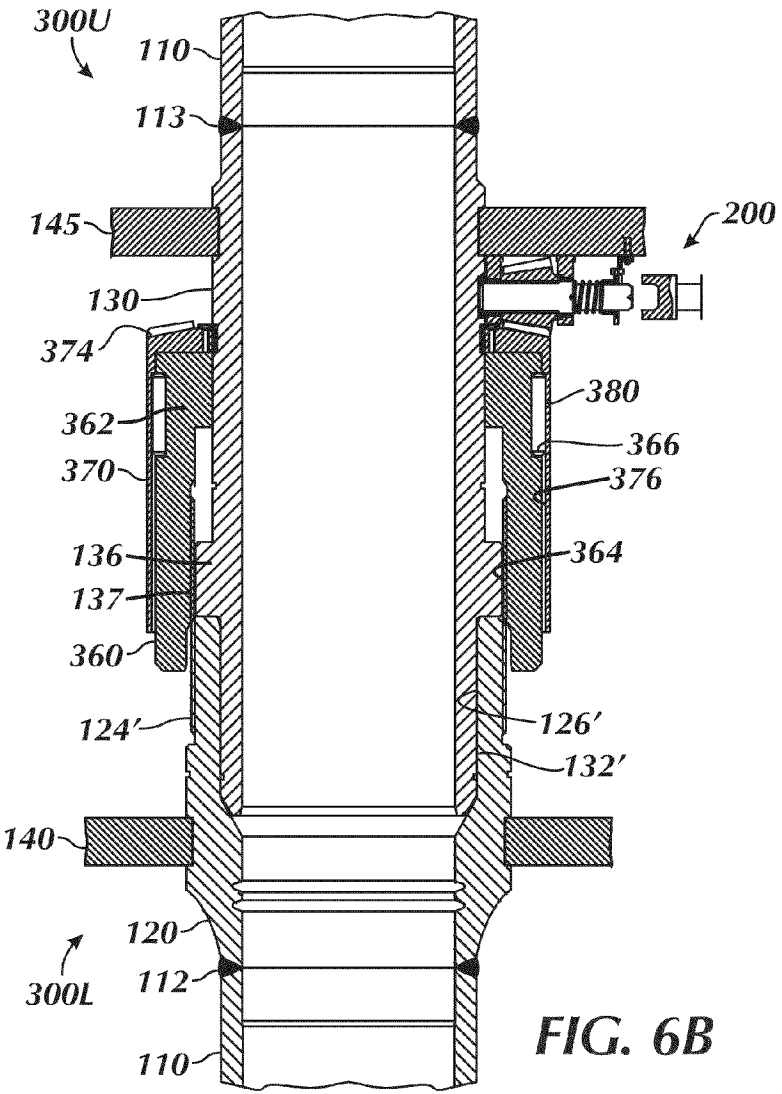
FIG. 6B is a cross-sectional view of FIG. 6A.
Figure 6A:
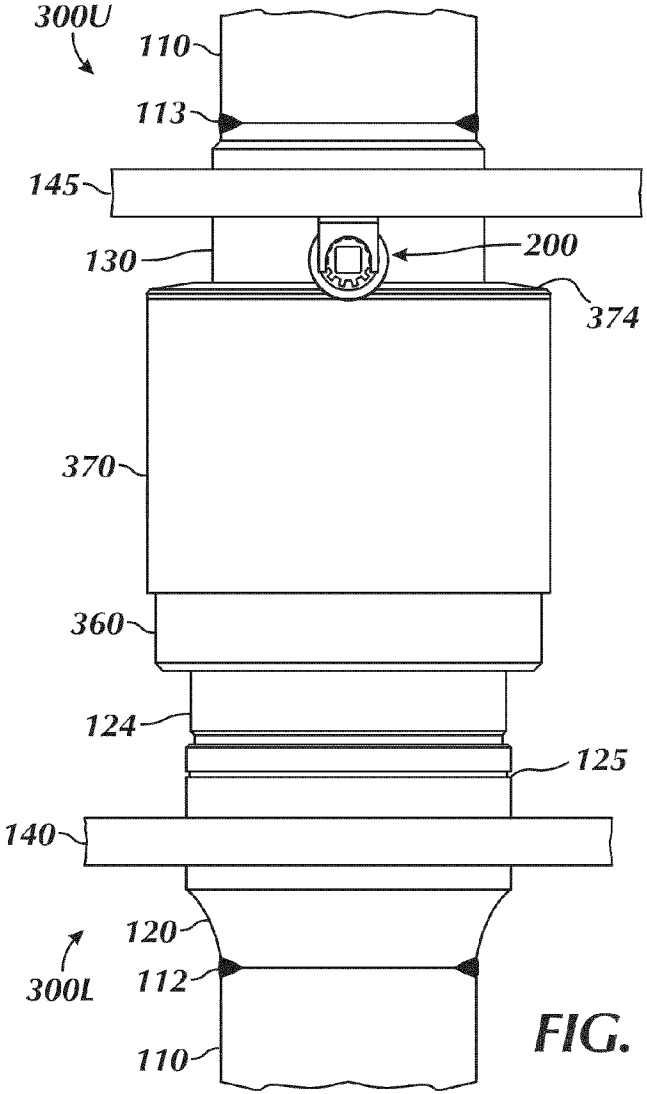
FIG. 6A is a view of another embodiment of riser joints being coupled together before screwing.

Another embodiment of a riser joint 300 is illustrated in FIGS. 6A though 7B. In FIGS. 6A-6B, upper and lower riser joints 300U-L are shown being coupled together. In contrast to the previous embodiment that used spring bias against a union nut, the present embodiment of the riser joints 300 does not. As shown and similar to the previous embodiment, each riser section 300U-L has a main pipe 110, upper and lower connectors 120/130, auxiliary supports 140/145, and a driver 200. In addition to these, each riser section 300U-L has other components similar to the previous embodiment so that like reference numbers are used between like components.

In contrast to previous embodiments, however, the upper connector 120 has a cylindrical box 126' and an external thread 124' that is cylindrical or tapered. In addition, the lower connector 130 has a cylindrical pin 132' for mating with the upper's cylindrical box 126'. Each riser section 300U-L also has a union nut 360 and a sleeve 370 that are different from previous embodiments. As best shown in FIG. 6B, the union nut 360 has a top portion 362 that fits around the lower connector 130. Internally, the union nut 360 has an internal thread 364 that is cylindrical or tapered. Externally, the union nut 360 has a plurality of external dowel seats 366.

As before, the sleeve 370 fits over the union nut 360 and is held longitudinally fixed but rotatable about the lower connector 130. In addition, the sleeve's upper edge 374 has beveled gear teeth that mate with the driver 200 for turning the sleeve 370. Rather than having fingers as before to engage the union nut 360, however, the sleeve 370 has longitudinal slots 376 along its interior. These slots 376 hold dowels or bearings 380 in the dowel seats 366 of the union nut 360 thereby coupling the sleeve 370 to the union nut 360. These dowels 380 can slide longitudinally in the slots 376.

When the upper and lower riser sections 300U-L are first coupled together as shown in FIGS. 6A-6B, the lower connector 130 inserts into the upper connector 120 so that the lower's cylindrical pin 132' fits inside the upper's cylindrical box 126'. The union nut 360 remains positioned away from the external thread 124' on the upper connector 120 so that the union nut's top 362 fits deep into sleeve 370. To hold the union nut 360 in this upward position, its internal thread 364 may simply engage (but not mate with) the external thread 124' on the upper connector 120

As operators then operate the driver 200, the sleeve 370 rotates. Through the coupling of the dowels 380 in the slots 376 and dowel seats 366, the union nut 360 likewise rotates. As it rotates, the union nut's thread 364 begins to thread with the upper connector's thread 124', and the union nut 360 moves further down along the connector 130. The sleeve 370, however, remains in position mated with the driver 200. Yet, the dowels 380 are allowed to move longitudinally in the slots 376 as the union nut 360 further mates with the connector's thread 124'.

Figure 7B:
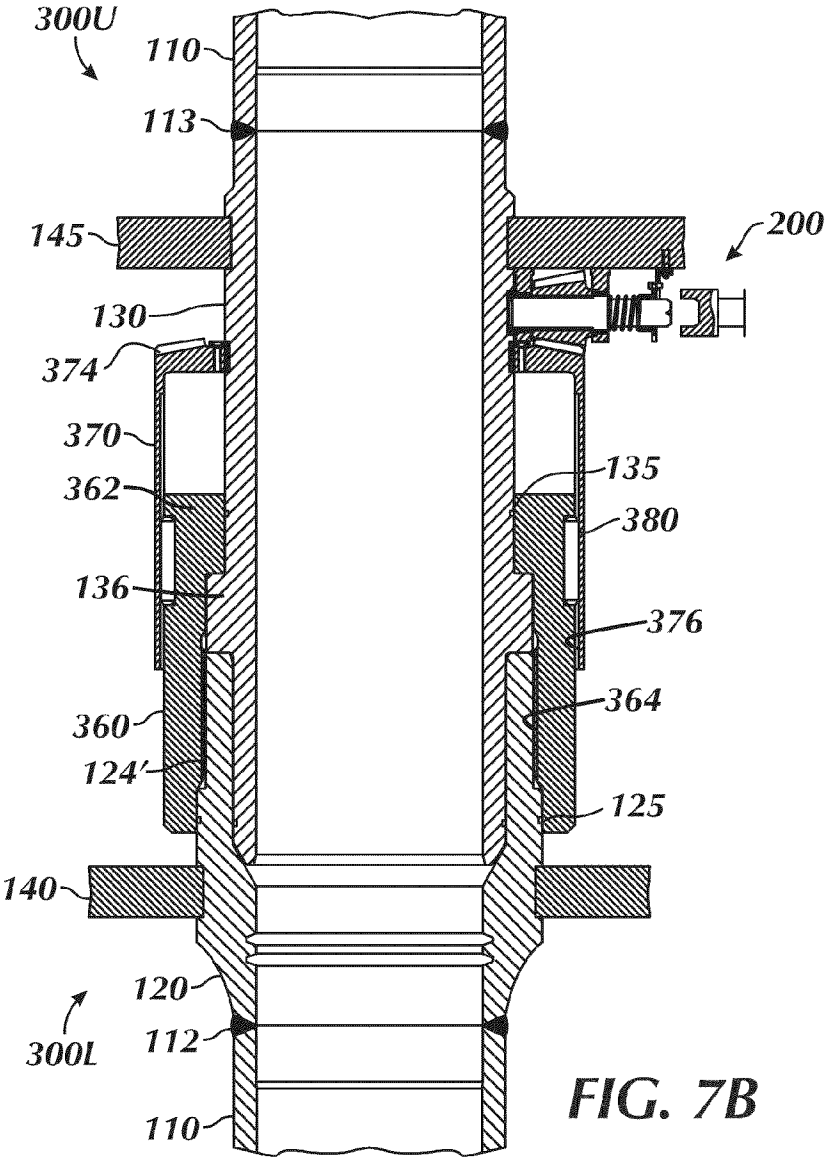
FIG. 7B is a cross-sectional view of FIG. 7A.
Figure 7A:
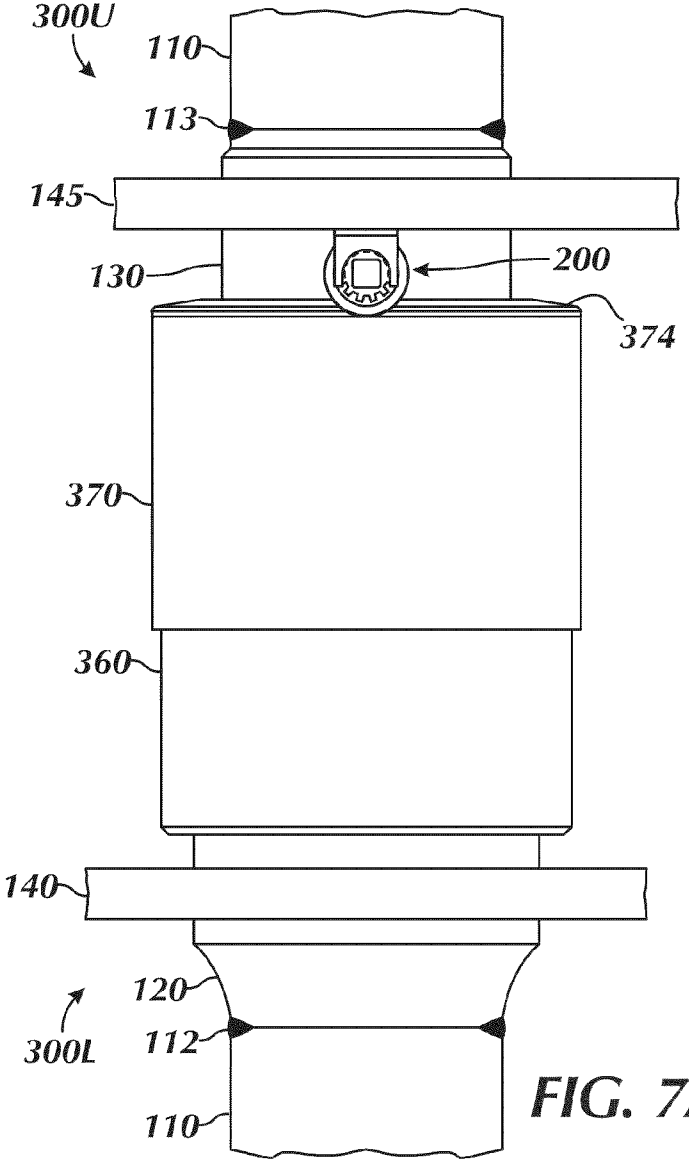
FIG. 7A is a view of the riser joints of FIG. 6A when coupled together after screwing is completed.

Operators continue to drive the sleeve 370 until the union nut 360 sufficiently couples with the upper connector 120, as shown in FIGS. 7A-7B. Once coupled, the sleeve's top portion 362 meets the collar 136 as shown in FIG. 7B. To further enhance the seal, the lower connector 130 can have an annular groove 135 for an O-ring seal (not shown) that seals against the inside of the union nut's top portion 362. Likewise, the upper connector 120 can have an annular groove 125 for an O-ring seal (not shown) that seals against the inside of the union nut's lower distal end.

Figure 8:
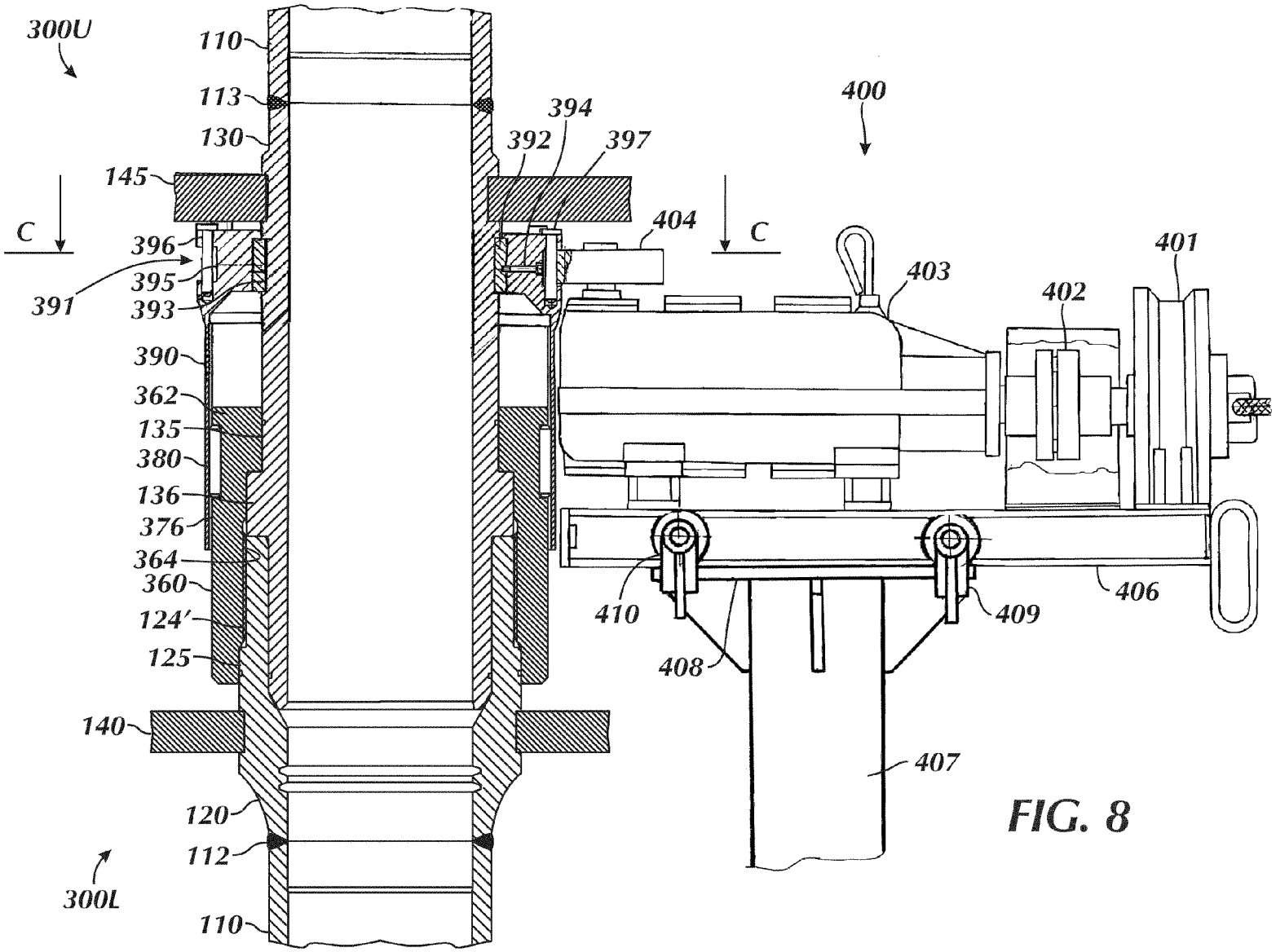
FIG. 8 is a partial cross-sectional view of two riser sections assembled together showing a sleeve and a driver having a pin gear and a trundle arrangement.
Figure 9:
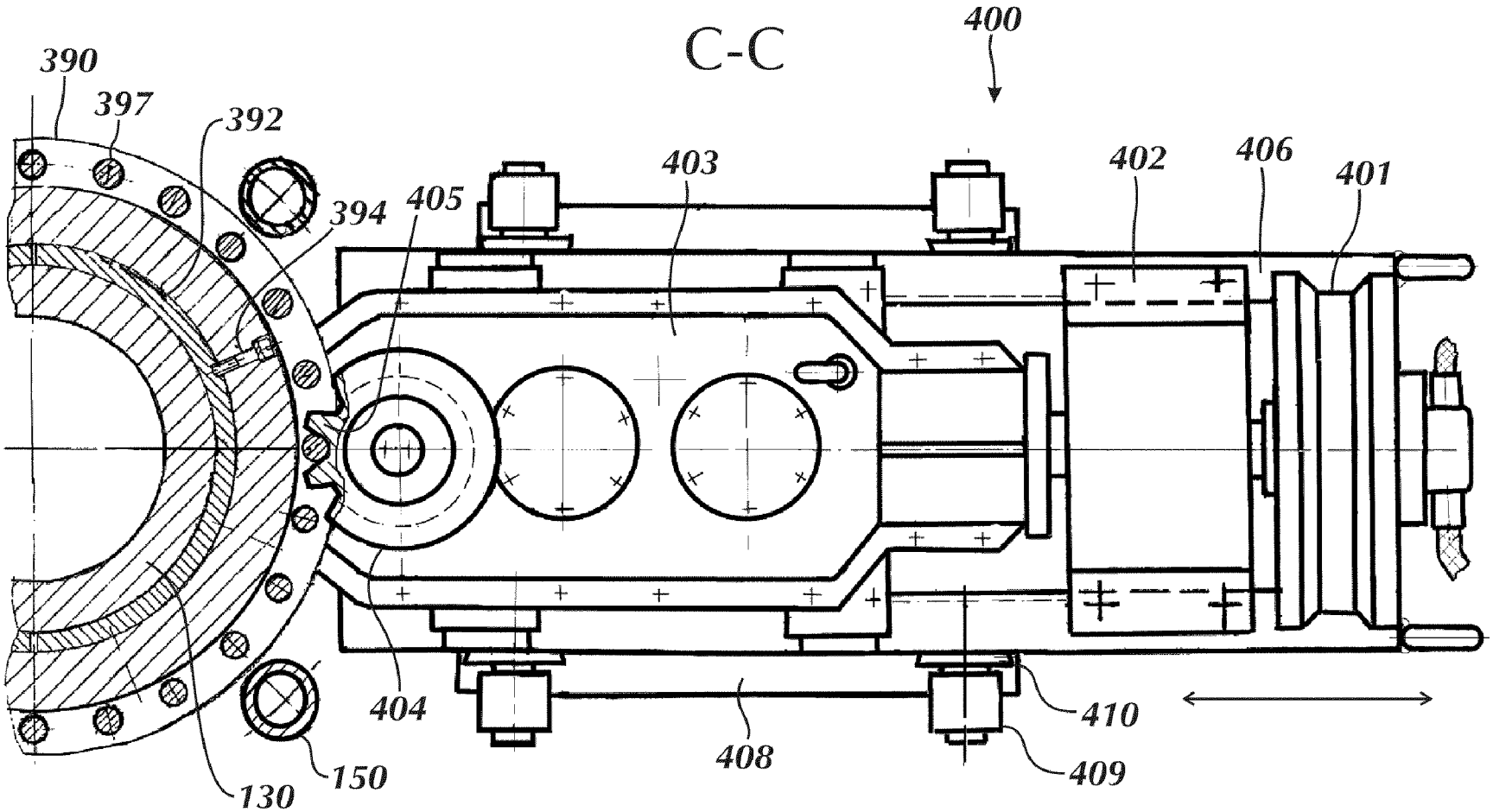
FIG. 9 is a cross-sectional view of the riser section in FIG. 8 along lines C-C.

In FIGS. 8-9, the riser section 300 uses another embodiment of a sleeve 390 and driver 400. As before, upper and lower riser joints 300 U-L are coupled together using the sleeve and driver 400. In contrast to the previous embodiment that used teeth on the beveled rim of the sleeve mating with a pinion gear, the present embodiment uses a pin gear or first sprocket 391 on the sleeve 390 that mates with a trundle or second sprocket 404 of a gear box 403 coupled to a high-torque hydraulic motor 401 of the driver 400.

As shown in FIGS. 8 and 9, a split bushing 392 fits into an outer groove 393 around the lower connector 130. As best shown in FIG. 9, the bushing 392 supports the sleeve 390 thereon using screws 394 (only one of which is shown). As before, the sleeve 390 best shown in FIG. 8 fits over the union nut 360 and is rotatable about the lower connector 130. At its upper end, the sleeve 390 has an external circular groove 395, and steel pins 397 insert through holes 396 to make the pin gear 391 at the upper end of the sleeve 390. As described below, this pin gear 391 can mate with teeth of the trundle 404 of driver 400 for turning the sleeve 390. The remaining components of the riser section 300 correspond to those elements discussed previously.

The driver 400 includes the high-torque hydraulic motor 401, a joint 402, and the gear box 403 that has the trundle 404 on its end. These components has are supported on a frame 406, which is in turn supported on a base plate 408 and a column base 407. The frame 406 is movable on the base plate 408 using rotatable rollers 410 positioned on bearing supports 409 connected to the base plate 408.

In operation, the frame 406 is moved on the rollers 410 away from the upper and lower riser sections 300U-L as they are first coupled together so the driver 400 is out of the way as the sections 300U-L are seated and the auxiliary pipes 150 are installed. When the sections 300U-L have been fully seated and the auxiliary pipes 150 have been coupled, operators then move the driver 400 on the rollers 410 so that the gear box's trundle 404 mates with the pins 397 of the sleeve's pin gear 391. Advantageously, the sprocket form of mating between the trundle 404 and pin gear 391 does not require exact alignment or meshing between the teeth and has a simplified construction.

Operated by the motor 401, joint 402, and gear box 403, the trundle 404 rotates the pin gear 391 and the sleeve 390. In turn, the sleeve 390 rotates the union nut 360 and mates the nut's thread 364 onto the lower section's outer thread 124'. As it is threaded, the union nut 360 moves further down along the connector 130 while the sleeve 390 remains in position mated with the driver 400. Yet, dowels 380 are allowed to move longitudinally in slots 376 as the union nut 360 further mates with connector's thread 124'. Operators continue to drive the sleeve 390 until the union nut 360 sufficiently couples with the upper connector 120. Once coupled, the union nut's top portion 362 meets the collar 136, as shown in FIG. 8. The amount of required torque to make up the connection can be controlled using appropriate pressure on a pressure gauge (not shown) of the driver 400.

The foregoing description of preferred and other embodiments is not intended to limit or restrict the scope or applicability of the inventive concepts conceived of by the Applicants. It will be appreciated that although assembly steps have been described for coupling riser sections together, reverse operations can be performed to uncouple riser sections from one another. Although beveled gears and sprockets have been described above, it will be appreciated that other types of gears or connections could be used to impart rotation from a drive to the sleeve. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A riser joint, comprising:

a pipe having first and second ends;

a first connector disposed on the first end of the pipe, the first connector having a first internal surface and having a first external surface with a first thread;

a second connector disposed on the second end of the pipe, the second connector having an external collar and having a second external surface engagable with the first internal surface;

a union nut disposed about the second connector and being axially and rotatably movable thereon, the union nut being engageable with the external collar and having a second internal surface, the second internal surface having a second thread mateable with the first thread of a first connector of another riser joint; and a sleeve rotatably disposed on the second connector, the sleeve being separate from the union nut and engaged with the union nut such that the union nut can move axially relative to the sleeve, the sleeve having a first gear and being rotatable via the first gear about the second connector, wherein rotation of the sleeve rotates the union nut to mate with the first connector of the other riser joint.

2. The riser joint of claim 1, further comprising:

a first clamp connectable about the first connector and supporting at least one auxiliary pipe adjacent the riser joint; and a second clamp connectable about the second connector and supporting the at least one auxiliary pipe adjacent the riser joint.

3. The riser joint of claim 1, wherein the first gear comprises a beveled gear disposed about an edge of the sleeve.

4. The riser joint of claim 3, further comprising a drive shaft having a pinion gear mating with the beveled gear, wherein rotation of the drive shaft around an axis rotates the sleeve around a perpendicular axis of the second riser joint.

5. The riser joint of claim 4, wherein a clamp disposed about the riser joint supports the drive shaft thereon.

6. The riser joint of claim 1, further comprising a spring disposed about the riser joint between the sleeve and the union nut and biasing the union nut toward the external collar.

7. The riser joint of claim 1, wherein the union nut comprises a plurality of slots, and wherein the sleeve comprises a plurality of extended fingers engageable with and longitudinally movable within the slots.

8. The riser joint of claim 1, wherein:

the sleeve comprises at least one longitudinal slot defined in an internal surface, the union nut comprises at least one pocket defined in an external surface of the union nut and positioning adjacent the internal surface of the sleeve, and the riser joint further comprises at least one dowel disposed in the at least one pocket and the at least one longitudinal slot.

9. The riser joint of claim 1, wherein the riser joint is composed of an aluminum alloy.

10. The riser joint of claim 1, wherein the second connector defines an external slot thereabout, and wherein a snap ring positioned in the external slot supports the sleeve on the second connector.

11. The riser joint of claim 1, wherein the first gear comprises a first sprocket disposed about a circumference of the sleeve.

12. The riser joint of claim 11, further comprising a drive having a second sprocket mateable with the first sprocket, wherein rotation of the second sprocket around an axis rotates the sleeve around a parallel axis of the second riser joint.

13. The riser joint of claim 1, further comprising a movably mounted drive having a second gear mateable with the first gear of the sleeve.

14. The riser of claim 13, wherein the drive is movably mounted on rollers.

15. A riser apparatus, comprising:

a first riser joint having a first end with a first external thread;

a second riser joint having a second end with an external shoulder;

a union nut disposed on the second end and being axially and rotatably movable thereon, the union nut being engageable with the external shoulder and having a first internal thread; and a sleeve disposed on the second end, the sleeve being separate from the union nut and engaged with the union nut such that the union nut can move axially relative to the sleeve, the sleeve having a first gear and being rotatable via the first gear, wherein the first end of the first riser joint adjoins the second end of the second riser joint, and wherein rotation of the sleeve on the first riser joint via the first gear rotates the union nut and threads the first internal thread of the union nut with the first external thread of the second riser joint.

16. A riser apparatus, comprising:

a plurality of riser joints, each of the riser joints having— a first end with a first external thread, a second end with an external shoulder, a union nut disposed on the second end and being axially and rotatably movable thereon, the union nut being engageable with the external shoulder and having a first internal thread, and a sleeve disposed on the second end, the sleeve being separate from the union nut and engaged with the union nut such that the union nut can move axially relative to the sleeve, the sleeve having a first gear and being rotatable via the first gear, wherein the first end of a first of the riser joints adjoins the second end of a second of the riser joints, and wherein rotation of the sleeve on the first riser joint via the first gear rotates the union nut and threads the first internal thread of the union nut with the first external thread of the second riser joint.

17. A riser apparatus, comprising:

a plurality of riser joints, each of the riser joints having— a first end, a second end adjoinable with the first end of another of the riser joints, first means disposed on the second end for mating with the first end of the other riser joint, the first means being rotatably and axially movable on the second end, and second means disposed on the second end separate from the first means for rotating the first means, the second means being rotatable, but not axially movable on the second end, wherein rotation of the first means on a first of the riser joints by the second means mates the first means with the first end of a second of the riser joints and couples the first and second riser joints together.

18. An offshore drilling or production system, comprising:

a platform; and a riser coupled to the platform, the riser comprising a plurality of riser joints coupled end-to-end, each of the riser joints comprising:

a first end with a first external thread, a second end with an external collar, a union nut disposed on the second end and being axially and rotatably movable thereon, the union nut being engageable with the external collar and having a first internal thread, and a sleeve disposed on the second end, the sleeve being separate from the union nut and engaged with the union nut such that the union nut can move axially relative to the sleeve, the sleeve having a first gear and being rotatable via the first gear, wherein the first end of a first of the riser joints adjoins the second end of a second of the riser joints, and wherein rotation of the sleeve on the first riser joint via the first gear rotates the union nut and threads the first internal thread of the union nut with the first external thread of the second riser joint.

19. A riser assembly method, comprising:

supporting a lower riser joint;

adjoining a first end of an upper riser joint with a second end of the lower riser joint;

coupling a drive to a gear on the upper riser joint;

rotating a sleeve on the upper riser joint with the drive and the gear;

rotating a union nut on the upper riser joint with the rotating sleeve, the sleeve being separate from the union nut and engaged with the union nut such that the union nut can move axially relative to the sleeve; and coupling the upper riser joint to the lower riser joint by threading the union nut onto the second end of the lower riser joint and allowing the union nut to move axially on the upper riser joint relative to the rotating sleeve.

20. The method of claim 19, further comprising:

positioning a first clamp about the first end of the upper riser joint; and positioning a second clamp about the second end of the lower riser joint; and interconnecting at least one auxiliary pipe between the first and second clamps adjacent the upper and lower riser joints.

21. The method of claim 19, wherein rotating the union nut comprises biasing the union nut toward the second end of the lower riser joint.

22. The method of claim 19, further comprising supporting the sleeve axially on the upper riser joint.

23. The method of claim 19, further comprising welding the first end on a first pipe of the upper riser joint, and welding the second end on a second pipe of the lower riser joint.

24. The method of claim 19, further comprising disposing a clamp about the upper riser joint and supporting the gear on the clamp.

25. The method of claim 19, further comprising:

releasing the lower riser joint;

lowering the riser assembly, and repeating the acts of adjoining, coupling, rotating, and threading to connect another upper riser joint to the riser assembly.

26. The riser apparatus of claim 15, wherein the union nut comprises a plurality of slots, and wherein the sleeve comprises a plurality of extended fingers engageable with and longitudinally movable within the slots.

27. The riser apparatus of claim 15, wherein:

the sleeve comprises at least one longitudinal slot defined in an internal surface, the union nut comprises at least one pocket defined in an external surface of the union nut and positioning adjacent the internal surface of the sleeve, and the riser apparatus further comprises at least one dowel disposed in the at least one pocket and the at least one longitudinal slot.

28. The riser apparatus of claim 15, further comprising a movably mounted drive having a second gear mateable with the first gear of the sleeve.

29. The riser apparatus of claim 28, wherein:

the first gear comprises a beveled gear disposed about an edge of the sleeve and the drive comprises a pinion gear mating with the beveled gear; or the first gear comprises a first sprocket disposed about a circumference of the sleeve and the drive comprises a second sprocket mateable with the first sprocket.

30. The riser apparatus of claim 16, wherein the union nut comprises a plurality of slots, and wherein the sleeve comprises a plurality of extended fingers engageable with and longitudinally movable within the slots.

31. The riser apparatus of claim 16, wherein:

the sleeve comprises at least one longitudinal slot defined in an internal surface, the union nut comprises at least one pocket defined in an external surface of the union nut and positioning adjacent the internal surface of the sleeve, and the riser apparatus further comprises at least one dowel disposed in the at least one pocket and the at least one longitudinal slot.

32. The riser apparatus of claim 16, further comprising a movably mounted drive having a second gear mateable with the first gear of the sleeve.

33. The riser apparatus of claim 32, wherein:

the first gear comprises a beveled gear disposed about an edge of the sleeve and the drive comprises a pinion gear mating with the beveled gear; or the first gear comprises a first sprocket disposed about a circumference of the sleeve and the drive comprises a second sprocket mateable with the first sprocket.

34. The system of claim 18, wherein the union nut comprises a plurality of slots, and wherein the sleeve comprises a plurality of extended fingers engageable with and longitudinally movable within the slots.

35. The system of claim 18, wherein:

the sleeve comprises at least one longitudinal slot defined in an internal surface, the union nut comprises at least one pocket defined in an external surface of the union nut and positioning adjacent the internal surface of the sleeve, and the riser joint further comprises at least one dowel disposed in the at least one pocket and the at least one longitudinal slot.

36. The system of claim 18, further comprising a movably mounted drive having a second gear mateable with the first gear of the sleeve.

37. The system of claim 36, wherein:

the first gear comprises a beveled gear disposed about an edge of the sleeve and the drive comprises a pinion gear mating with the beveled gear; or the first gear comprises a first sprocket disposed about a circumference of the sleeve and the drive comprises a second sprocket mateable with the first sprocket.

* * * * *